US005944453A

United States Patent [19]

Gryba

[11] Patent Number: 5,944,453

[45] Date of Patent: Aug. 31, 1999

[54] UNDERCUT EXCAVATION WITH PROTECTION AGAINST SEISMIC EVENTS OR EXCESSIVE GROUND MOVEMENT

[75] Inventor: Charles M. Gryba, Toronto, Canada

[73] Assignee: 998492 Ontario Inc., Aurora, Canada

[21] Appl. No.: 09/057,874

[22] Filed: Apr. 9, 1998

[30] Foreign Application Priority Data

Apr. 16, 1997 [CA] Canada ..... 2202851

[51] Int. Cl.[6] ..... E02D 5/30

[52] U.S. Cl. ..... 405/233; 52/169.9; 405/229

[58] Field of Search ..... 405/149, 249, 405/133, 132; 52/167.7, 167.8, 741.15

[56] References Cited

U.S. PATENT DOCUMENTS

| | | | |
|---|---|---|---|
| 1,746,566 | 2/1930 | Tufts | 405/149 |
| 2,194,279 | 3/1940 | Goldsborough | 405/149 |
| 4,045,968 | 9/1977 | Gerwick | 52/167.7 X |
| 4,073,148 | 2/1978 | Zaretti | 405/149 X |
| 4,266,379 | 5/1981 | Aguilar | 52/167.8 X |
| 4,574,540 | 3/1986 | Shiau | 52/167.8 |
| 4,887,398 | 12/1989 | Lenten | 52/167.7 |
| 4,990,026 | 2/1991 | Ofenstein | 405/249 X |
| 5,522,676 | 6/1996 | Gryba . | |

*Primary Examiner*—Dennis L. Taylor
*Attorney, Agent, or Firm*—George J. Primak

[57] ABSTRACT

An undercut excavation method is provided, which is particularly suitable as an undercut-and-fill mining method, wherein concrete posts are inserted into holes drilled in the ground and are used to support a concrete floor poured on their top ends, which serves as a roof for the lower excavation level. The bottom ends of these posts rest on resilient elements to provide protection against seismic events or excessive ground movements. Excavation beneath such roof is thereby safely carried out in areas prone to seismic events such as rock bursts or earth quakes or to excessive ground movements. The concrete posts may be attached to the resilient elements at their bottom ends, thereby producing yielding posts suitable for such excavation. For still greater safety, a double post system may be used, which involves placing a second post beside the first after excavation on a given level and tying them all together with the concrete used to make the floor/roof for the next lower level of excavation. In mining this is called double-post mining or DPM.

19 Claims, 3 Drawing Sheets

UNDERCUT EXCAVATION WITH PROTECTION AGAINST SEISMIC EVENTS OR EXCESSIVE GROUND MOVEMENT

BACKGROUND OF THE INVENTION

1. Field of the Invention

This invention relates to a method for excavation from the top down, usually known as "undercut" excavation which also comprises protection against seismic events such as rock bursts or earth quakes as well as from excessive but relatively slow ground movement. More particularly the invention relates to an undercut excavation method using concrete posts which are adapted to support concrete floors that become a roof for the next lower level of excavation and wherein the posts are combined with resilient elements to provide protection against seismic events or against ground movement that exceeds failure load of the concrete posts.

2. Discussion of the Prior Art

Applicant's U.S. Pat. No. 5,522,676 of Jun. 4, 1996 discloses an undercut excavation method wherein, as the first step, posts are inserted into the ground, which may be done by drilling holes in the ground and inserting concrete posts in such holes, and further these posts have top ends capable of supporting a concrete roof and are inserted into the ground so that their top ends are essentially flush with the ground; then a concrete floor is poured on the ground and on the top ends of the posts; and finally safe excavation proceeds beneath the concrete floor which now serves as a concrete roof for the excavation.

The above method also provides for a multi-level undercut excavation, such as an undercut-and-fill mining method, whereby the same procedure is repeated at each level as the excavation progresses downwardly from level to level until a desired number of levels has thus been excavated. In the undercut-and-fill mining method, the excavated rooms are back-filled with a suitable fill after excavating the same. Moreover, holes may be drilled around the posts inserted into the ground, and blasted with explosives to break the ground around the posts without, however, damaging the posts themselves. This facilitates excavation under the concrete floor/roof thereafter and minimizes damage to the posts during excavation.

It has also been disclosed in said U.S. Pat. No. 5,522,676 that additional posts may be stood-up in plumb on top of the posts previously inserted into the holes to provide further support to the concrete roof and thus an enhanced safety. This is called "double post" excavation, or when applied to mining "double post mining" or "DPM".

When a set of concrete posts is installed in holes in an undercut excavation as mentioned above or as part of the double post excavation or DPM, the posts have zero load. Once the concrete floor/roof has been cast and the excavation has been performed, there will be a load applied to the posts. If the excavation is only a one level excavation, it is likely that there may be a structure placed over it, such as a building or the like, which will exert an additional load onto the posts over and above the load exerted by the floor/roof poured thereover. The same applies to a multi-level excavation. Also in a mining undercut-and-fill method, loads are transmitted to the posts via the backfill as the rock or ore formations move or relax. The concrete posts are, of course, rigid and they could overload and fail particularly during seismic events, such as a rock burst or earth quake, which may produce massive energy releases.

SUMMARY OF THE INVENTION

It is, therefore, an object of the present invention to provide a method of undercut excavation or mining, which will include protection against seismic events, such as rock bursts or earth quakes or against excessive ground movement.

A further object of the invention is to achieve such protection in a simple and efficient manner.

A still further object of the present invention is to provide safe excavation and mining in zones or areas prone to strong earth quakes or rock bursts or excessive ground movement.

Other objects and advantages of the invention will be apparent from the following description thereof.

In essence the method of excavation of the present invention comprises:

(a) drilling holes of predetermined size and length in the ground;

(b) placing at the bottom of said holes resilient elements capable of absorbing shock energy or excessive loads due to ground movement;

(c) inserting concrete posts into said holes, these posts having their bottom ends resting on the resilient elements and having their top ends essentially flush with the ground, the posts being capable of supporting a concrete roof on their top ends;

(d) pouring a concrete floor on the ground and on the top ends of the posts, and (e) excavating beneath the concrete floor which now serves as the concrete roof for the excavation, with the resilient elements providing protection against seismic events in the area of the excavation or against ground movement exceeding failure load of the concrete posts.

When reference is made herein to concrete posts, these include reinforced concrete posts and when reference is made to pouring a concrete floor on the ground and on the top ends of the posts, it also includes the pouring or casting of a reinforced concrete floor, i.e. a floor designed with rebar and screen elements within the concrete, so that the posts cannot puncture the same.

The novel method is particularly suitable for multi-level excavation in areas prone to strong earth movements, such as earth quakes and the like. In cases, for example, where a multi-level underground garage is built in this manner, once the excavation on the first level is completed, new holes are drilled in the ground of such first excavated level and resilient elements capable of absorbing shock energy are placed in these new holes, and new concrete posts are inserted into the new holes to rest on the resilient elements and a concrete floor is poured on the ground of the first excavation level to be supported by the new posts, and then excavation is pursued on the new lower level under this concrete floor which now serves as a roof for this new lower excavation level, while the resilient elements on which the new posts rest now provide protection against seismic events as well as against excessive ground movement generally.

The invention is also particularly suitable for carrying out undercut-and-fill mining in areas prone to strong rock bursts and excessive rock movements. Such mining method essentially comprises:

(a) cutting initial drifts in an underground mine to form rooms in a conventional manner with a sill at the upper end of our ore body, and recovering the mined material from such rooms;

(b) drilling holes of a predetermined size and length in the sill of each room;

(c) placing resilient elements at the bottom of the holes capable of absorbing shock energy or excessive loads due to rock movement;

(d) inserting concrete posts in these holes to rest on the resilient elements with their bottom ends and having their top ends essentially flush with the sill of the rooms;

(e) pouring a concrete floor in the rooms to be supported by the top ends of the posts;

(f) back filling the rooms with a suitable fill after they have been mined out;

(g) once a complete lift has been so mined, repeating this mining procedure on a lower level where the concrete floors now serve as a roof supported by the concrete posts and the resilient elements serve as protection against seismic events, such as rock bursts or against rock movement exceeding failure load of the concrete posts; and (h) continuing mining in this manner from level to level until the desired ore body is mined, with the resilient elements under the posts of the lowermost level serving as protection against seismic events and excessive rock movements to which the mine may be exposed.

It should be emphasized that in the case of multi-level excavation or mining, it is the resilient elements of the lowermost level that provide protection against the seismic events and excessive ground movement, and the elements used at higher levels may be recovered and reused at lower levels.

Furthermore, additional posts may be stood-up on top of the concrete posts inserted into holes drilled in the ground or in the mine sill at each level of excavation, so as to exert pressure on these concrete posts and provide suitable load on said posts and on the resilient elements on which they rest, thereby transmitting protection against seismic events and excessive ground movement to the upper levels of the excavated body or mine. These additional posts may be concrete posts but they may also be posts other than concrete posts, such as posts made of timber or steel. The additional posts are preferably positioned adjacent to the original posts supporting the concrete roof so as to facilitate tying them all together when the concrete floor is poured at the new level. In the case of mining, this is called a double-post mining or DPM, where the posts at the lowermost level resting on the resilient elements provide protection against seismic events or excessive ground movement in the mined area.

It should also be mentioned that the holes drilled in the ground or in the sill of a mine are preferably deeper than the sill of the next lower level and extend below the floor of such next level by a sufficient distance to accommodate the resilient elements under the sill or floor level of the next excavation. In this manner such elements may be easily recovered during the excavation of the next lower level and reused in further lower levels of excavation or mining. Moreover, so that the resilient elements are not lost during the excavation of the lower level, they may be attached to a suitable chain or rope in order to facilitate their subsequent recovery.

Furthermore, in rock or mine excavations, and particularly where the excavation is done by a drill-and-blast method, it is preferable to drill small blast holes around the holes with inserted concrete posts and to blast the same to break the ground around the posts without damaging said posts, so as to facilitate subsequent excavation under the concrete roof supported by these posts.

It should be noted that rigid concrete posts, including reinforced concrete posts are vulnerable to shock loads and rapid earth movements that exceed 1 or 2 centimetres. Such seismic events will cause immediate failure of the concrete posts. Also, even slow steady movement that exceeds the compressive ability of rigid reinforced concrete will cause post failure. For a concrete post 5 m in length, a load that produces a movement exceeding about 2 cm will cause failure.

According to the present invention, by placing a resilient element under the concrete post, one creates a yielding post out of what is normally a very rigid member. This resilient element may be, for example, an engineered solid spring, e.g. a plastic spring, which may either be placed at the bottom of the hole into which the concrete post is subsequently inserted or it may be attached to the bottom end of the post.

In lieu of the spring one may use a plastic block or a plastic element, for example, in the form of a doughnut, made of an engineered plastic such as Tecspak™ manufactured by DuPont and which has excellent ability to absorb shock loads and may be designed to compress like a spring.

For example, one can thus design a spring or spring like resilient element for withstanding ten times the movement of a rigid concrete post (20 cm), yet maintaining the support design load of the post. Thus, a range of movements that would cause the post to fail in compression would simply compress the spring or spring like resilient element while maintaining post loads below failure loading.

In fact, by electing proper materials and processing conditions, a very specific spring rate may be obtained. For instance, if rock mechanics modelling suggests that one has to design for 10 cm movement at 400 tonnes of load pressure, the plastic spring or block or other suitable such resilient element may be designed specifically for such set of parameters. This is particularly important for deep mining applications which may result in serious rock bursts. The ability to engineer and install the posts so as to absorb such shock loads in a controlled manner limits the damage area and considerably improves mining safety.

BRIEF DESCRIPTION OF THE DRAWINGS

The invention will now be described, by way of example, with reference to the accompanying drawings in which the same parts are designated by the same numerals, and in which.

DESCRIPTION OF THE PREFERRED EMBODIMENTS

Figure 1:
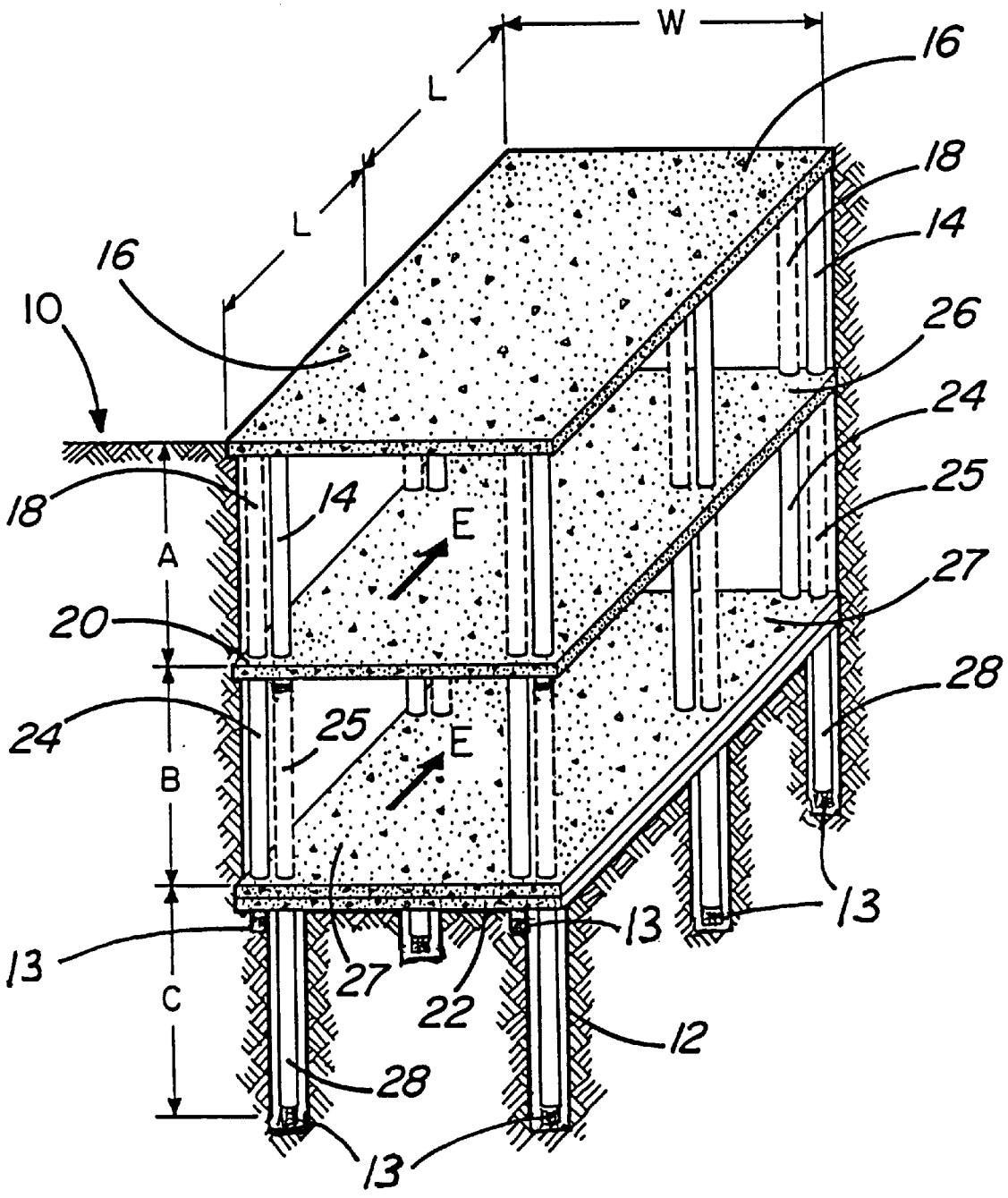
FIG. 1 is a perspective view of an excavation according to the method of the present invention.

Referring to the drawings, in FIG. 1 ground 10 represents any surface from which the excavation according to the present invention proceeds in the downward direction. In this ground 10, which can be on the surface of the earth or in an underground mine, holes such as hole 12 are drilled using, for example, Ingersol Rand's DTH drills, cluster drills or rotary drills. For example, 0.5 m diameter and about 5.2 m deep holes 12 would be drilled at a distance of 8 meters from one another in the longitudinal direction L and in width W. Resilient elements 13, such as plastic blocks or springs capable of absorbing shock energy, are placed in these holes 12 and concrete posts 14 of about 0.45 m in diameter and approximately 5 m in length are inserted into these holes 12 to rest on the resilient elements 13. These concrete posts are preferably made of reinforced concrete using rebars or the like as reinforcing elements and once they are placed in holes 12, their top ends are essentially flush with the ground. Once this is accomplished, a concrete floor 16, having a thickness 0.2–0.3 m, is poured on the ground which is preferably provided with a layer of broken rock or ore prior to pouring the concrete. The concrete is also preferably reinforced with screens and rebars as is known in the art to give it greater strength.

Once the concrete floor has been poured, i.e. cast, excavation proceeds thereunder, for example, in the direction of arrow E. This excavation can be done by any suitable means and it will be obvious that during such excavation the floor 16 will serve as a solid roof for the excavated space thereunder. In such manner, excavation at level A can proceed safely and efficiently. Also the 8 m×8 m spacings allow for heavy excavation machinery to be used, such as LHDs for mucking, 15 ton trucks to truck ore or dump fill, a single or double boom hydraulic jumbo for drilling, a boom truck for mechanized post handling and so on.

As the excavation at level A proceeds, further holes are drilled of the same size and height as holes 12. In plan these holes are drilled off-plumb and immediately adjacent to the existing concrete posts 14. Again resilient elements 13 are placed at the bottom of these holes. Then concrete posts 24 are inserted into said holes to rest on said resilient elements 13. These posts 24 are essentially identical to posts 14, previously inserted into the ground at level A. On top of posts 24, additional posts 18, shown in broken lines, are stood-up and blocked between the ground 20 of level A and the floor/roof 16. These filler posts 18 are similar to posts 14 and 24 but slightly shorter in length so that they can tightly fit between the top of post 24 and the floor/roof 16 and provide extra support for the floor/roof 16. Once all these posts 14, 18 and 24 are properly positioned and secured, concrete floor 26 is poured to tie-in the posts at the bottom 20, thus solidifying the entire structure. Rebar and screen is preferably installed between the various posts to provide reinforcement when the concrete is poured. Once level A is thus excavated or mined, it may be back-filled with appropriate filling material.

The same procedure is then repeated at level B where, as the excavation proceeds, holes 12 are drilled in plumb below posts 14 and resilient elements 13 are placed at the bottom of said holes. Posts 28 are then inserted therein to rest on said resilient elements 13. Thereafter posts 25, shown in broken lines, are stood up at level B on top of posts 28 and secured between said posts 28 and the roof 26 or rather the bottom ends of posts 14 which would normally extend under roof 26. These additional posts 25 are tightly fitted between the top ends of posts 28 and the bottom ends of posts 14. The posts 25 are undamaged by any prior excavating operation and will, therefore, provide additional safe support for the floor above even when it is back-filled and will also help transmit protection against seismic events or excessive loads to the upper levels. Again, once posts 24, 25 and 28 are properly positioned and secured, concrete floor 27 is poured to tie their ends with concrete and solidify the entire structure. The same procedure may then be repeated for level C and any additional levels in the downward direction. As mentioned previously, a layer 22 of broken rock or ore is preferably provided prior to pouring the concrete floor 27. In any such excavation the resilient elements 13 at the lowermost level provide protection against seismic events, such as rock bursts or earth quakes or excessive ground movement.

Figure 2:
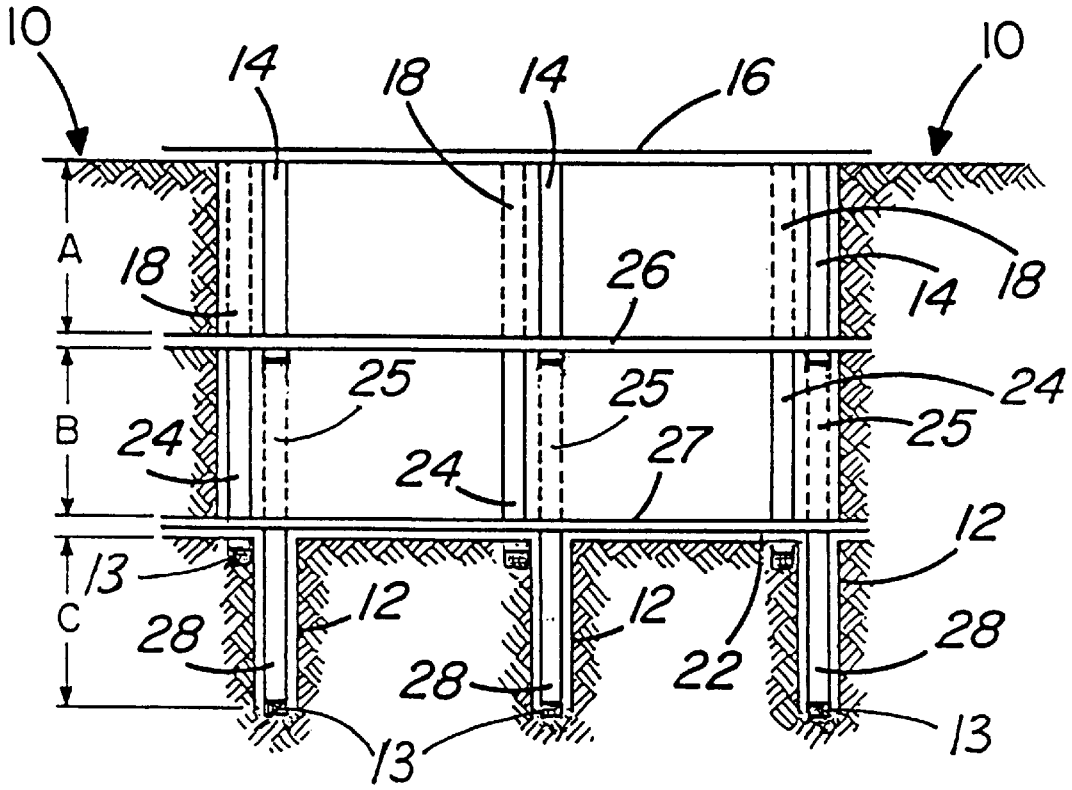
FIG. 2 is a section view of such excavation.

FIG. 2 is a section view of the same excavation system as shown in FIG. 1. The excavation proceeds from ground 10 downwards. Posts 14 extend somewhat below floor/roof 26. Initially, there are provided resilient elements 13 under posts 14, but they are subsequently removed during excavation of level B. These resilient elements 13 are shown under posts 24 and posts 28. Only resilient elements under posts 28, which are inserted into holes 12, provide protection against seismic events or excessive loads for the entire excavation; those under posts 24 will be removed when the excavation of level C is carried out. Posts 14, 24 and 28 extend deeper than the respective floors/roofs at each level to provide suitable space for the resilient elements under the said posts. When excavation of level C is carried out, resilient elements 13 under posts 24 may be recovered and reused at a lower level.

Posts 18 and 25 are stood-up in plumb on posts 24 and 28 respectively to provide further protection during excavation. However protection against seismic events or excessive ground movement is provided only by the resilient elements 13 placed under posts 28 when the upper levels have been excavated.

Figure 3:
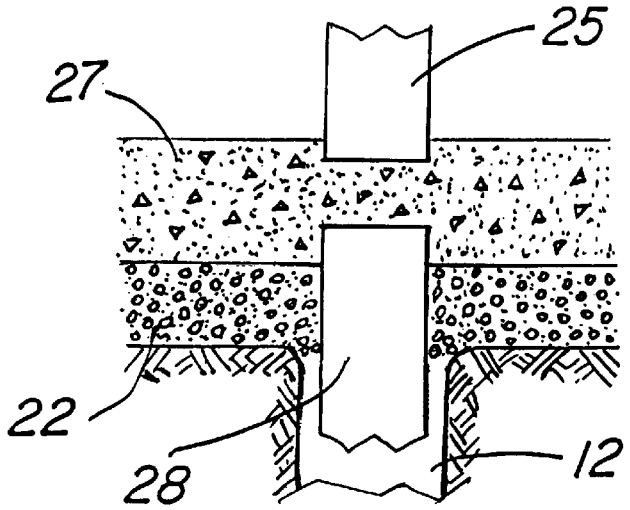
FIG. 3 is a detailed view of double post arrangement.

As better illustrated in FIG. 3, top ends of the concrete posts, such as post 28, are essentially flush with the ground at their respective level of excavation, however they preferably extend slightly above the ground or the broken rock or ore 22 and penetrate into the concrete floor/roof 27, but without piercing or puncturing said concrete floor/roof. For example, the top end of the concrete posts may so extent 5–8 cm into the concrete floor/roof which is normally 20–30 cm thick. This stabilizes the concrete posts, such as post 28, so that they cannot fall over during rock bursts or excessive ground movements. The bottom ends of the stood-up posts, such as post 25, will also preferably slightly penetrate (e.g. 2–5 cm) into the concrete floor 25 for stability purposes, but without touching the top ends of the concrete posts, such as post 28.

Figure 4:
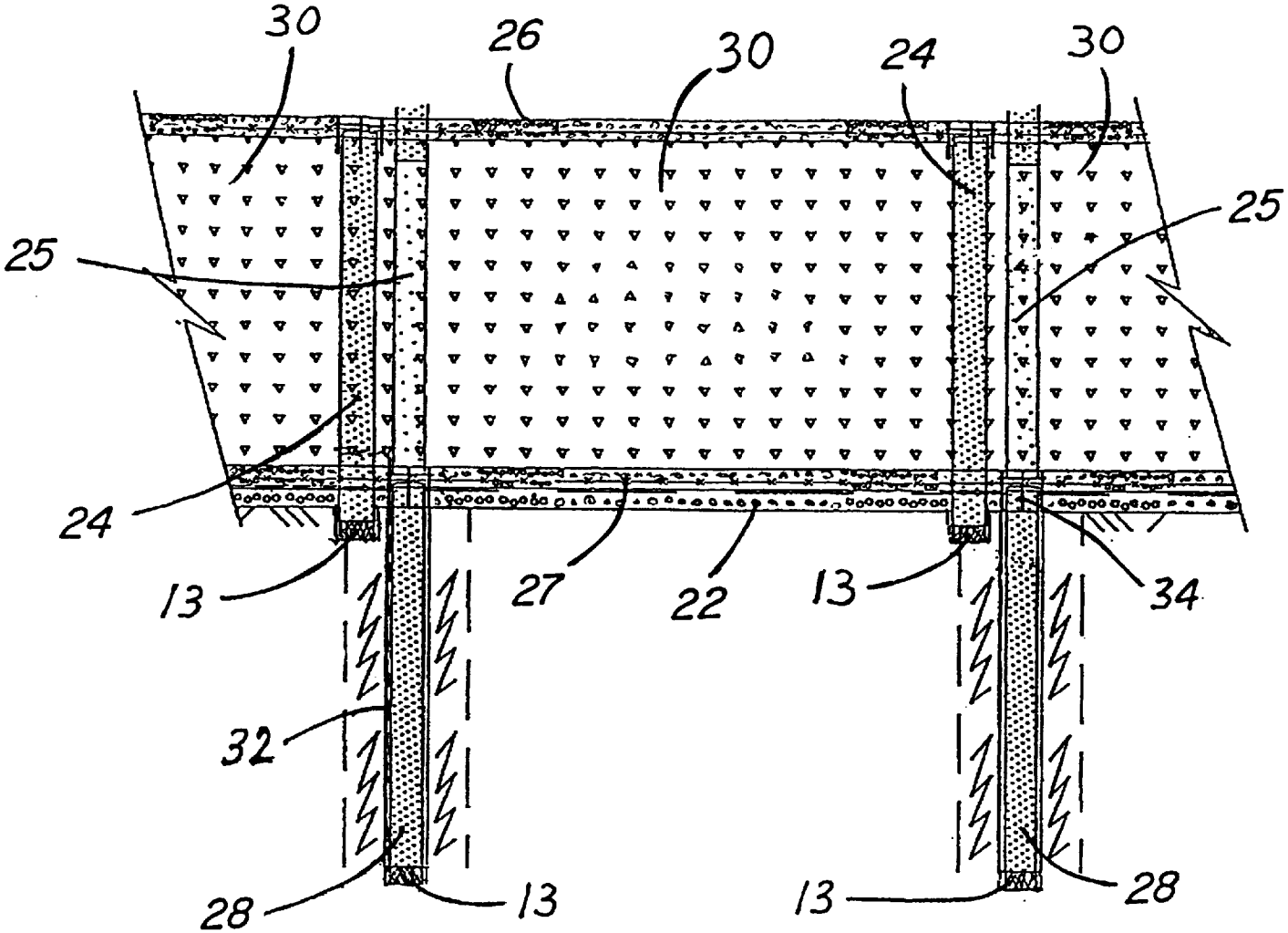
FIG. 4 is a partial section view of a double-post mining excavation with back filling of the previously excavated rooms.

In FIG. 4 there is shown a section of a double-post mining operation or DPM. In this case it is shown that the drifts at the excavated level have been filled with a suitable filler material 30, such as, for example, a 5% cement-rock fill. Since according to the present invention several rooms can be opened at the same time, the pouring of concrete floors, drilling of holes, placing of posts and back filling of rooms will not slow down the drill-blast-muck-fill cycles of the mining operation. Slinger trucks may be used for tight back-filling with cemented rock fill, but paste fill or cemented sand could also be employed for back-filling. Posts 24 and 28 are re-inforced concrete posts placed in holes prior to excavation at their respective levels and resting on resilient elements 13. Usually these resilient elements 13 will be recovered when the excavation proceeds. For example, resilient elements 13 which are under posts 24 may be recovered when the excavation is carried out under the floor/roof 27 and may then be reused at another lower level. In order not to lose these resilient elements 13, they may be attached by means of chains 32.

Posts 24 project below floor/roof 26 to provide space for installing resilient elements 13 and to have their upper ends essentially flush with the ground on which floor/roof 26 is poured or cast. The same is true of posts 28. Prior to pouring the concrete floor 27, a layer of broken rock or ore 22 may be provided to improve concrete adherence. On top of posts 28, additional posts 25 are stood-up (as more clearly shown in FIG. 3) and may be connected to posts 28 by rebars 34 or similar connecting members. These posts 25 apply pressure on posts 28 to keep them under suitable load. Also, prior to excavation under floor/roof 27 one may drill small holes around posts 28 and blast them to break the ground around these posts without damaging the same. This helps to perform subsequent excavation at the level below floor/roof 27 without damaging posts 28, particularly if such excavation is carried out by drill-and-blast techniques. Also, when floor/roof 27 is cast, it ties-up all the ends of the posts 24, 25 and 28 together, thereby forming a strong and secure supporting structure for the excavation below.

It should be understood that the invention is not limited to the above described preferred embodiments, but that various modification obvious to those skilled in the art can be made without departing from the spirit of the invention and the scope of the following claims.

I claim:

1. A method of excavation which comprises:

(a) drilling holes of predetermined size and length in the ground;

(b) placing at the bottom of said holes resilient elements capable of absorbing shock energy or excessive loads due to ground movement;

(c) inserting concrete posts into said holes, said posts having their bottom ends resting on said resilient elements and having their top ends essentially flush with the ground, said posts being capable of supporting a concrete roof on said top ends;

(d) pouring a concrete floor on said ground and on the top ends of said posts, and (e) excavating beneath said concrete floor which now serves as the concrete roof for the excavation, with said resilient elements providing protection against seismic events in the area of the excavation or against ground movement exceeding failure load of the concrete posts.

2. A method according to claim 1, in which once the excavation on the first level is completed, drilling new holes in the ground of said first excavated level, placing resilient elements capable of absorbing shock energy or excessive loads in said new holes, inserting new concrete posts into said new holes to rest on said resilient elements, pouring a concrete floor is on said ground to be supported by said new posts, and pursuing the excavation on a new lower level under said concrete floor which now serves as a roof for the new lower excavation level, while the resilient elements on which said new posts rest now provide protection against seismic events in the area of the excavation or against ground movement exceeding failure load of the concrete posts.

3. A method according to claim 2, comprising drilling the new holes in the ground of said first excavation and inserting the new concrete posts into said holes to be positioned beside the posts that were previously inserted into the ground at the higher level and the resilient elements provided under said new posts taking over the function of protection against seismic events or excessive ground movement from the resilient elements inserted at the higher level which lose their effectiveness upon excavation at the higher level.

4. A method according to claim 2, comprising standing additional posts on top of the new posts to provide additional support for the roof of the excavation and to exert pressure on the new concrete posts so as to keep them under suitable load and optimize the effect of the resilient elements placed under said new concrete posts.

5. A method according to claim 2, comprising carrying out further levels of excavation in the same manner until a desired number of levels has been excavated, with the resilient elements under the concrete posts of the lowermost level providing protection against seismic events or excessive ground movement in the area of the excavation.

6. An undercut-and-fill mining method, which comprises:

(a) cutting initial drifts in an underground mine to form rooms in a conventional manner with a sill at the upper end of an ore body, and recovering the mined material from said rooms;

(b) drilling holes of a predetermined size and length in the sill of each room;

(c) placing resilient elements at the bottom of said holes capable of absorbing shock energy or excessive loads due to ground movement;

(d) inserting concrete posts in said holes to rest on said resilient elements with their bottom ends and having their top ends essentially flush with the sill of the rooms;

(e) pouring a concrete floor in said rooms to be supported by the top ends of said posts;

(f) back filling the rooms with a suitable fill;

(g) once a complete lift has been so mined, repeating this mining procedure on a lower level where the concrete floors now serve as a roof supported by said posts and said resilient elements serve as protection against seismic events, such as rock bursts or against ground movement exceeding failure loads of the concrete posts; and h) continuing mining in this manner from level to level until the desired ore body is mined, with the resilient elements under the posts of the lowermost level serving as protection against seismic events to which the mine may be exposed.

7. A method as claimed in claim 6, comprising standing additional posts on top of the concrete posts inserted into holes drilled into the sill of each room under the concrete roof, so as to exert pressure and provide suitable load on said concrete posts and on the resilient elements on which they rest and thereby transmit protection against seismic events or excessive ground movement to the upper levels of the mine.

8. A method according to claim 7, comprising positioning said additional posts adjacent to the posts supporting the concrete roof so as to facilitate tying them all together when pouring the concrete floor in the sill of the mined level and thereby providing a double-post mining system in which the posts at the lowermost level resting on the resilient elements provide protection against seismic events or excessive ground movement in the mine.

9. A method according to claim 6, comprising having the top ends of the concrete posts penetrate into the concrete floor, but without puncturing the concrete floor.

10. A method according to claim 7, comprising having the bottom ends of the stood-up additional posts slightly penetrate into the concrete floor, but without touching the top ends of the concrete posts.

11. Method according to claim 6, comprising drilling the holes in the sill of the mined level deeper than the sill of the next lower level to extend below said sill at the next lower level by a sufficient distance to accommodate the resilient elements under the concrete floor level of the next excavation.

12. Method according to claim 11, comprising recovering during the excavation the resilient elements inserted into the holes drilled at the level above current excavation and reusing said resilient element in subsequent holes drilled in the sill of a lower level.

13. Method according to claim 12, comprising attaching the resilient elements to a suitable chain or rope to facilitate their recovery.

14. Method according to claim 6, in which small blast holes are drilled around the holes with inserted posts and are blasted to break the ground around said posts without damaging the posts.

15. Method according to claim 6, comprising providing resilient elements consisting of a plastic spring designed to compress more and faster than the reinforced concrete posts resting thereon, so that seismic events that would cause the posts to fail would merely compress the spring while maintaining post loads below failure loading.

16. Method according to claim 6, comprising providing the resilient elements consisting of a suitably engineered plastic squeeze block made of plastic material which absorbs shock loads and is designed to compress like a spring.

17. Method according to claim 6, comprising connecting the resilient elements to the bottom ends of the posts.

18. A yield post for an undercut excavation method, which is a post made of concrete and which has a resilient element capable of absorbing shock energy or excessive loads connected to the bottom end thereof said resilient element having essentially the same cross-sectional area as the bottom of the post to which it is connected.

19. A yield post according to claim 18, in which said resilient element is removably connected to the bottom of said post.

* * * * *